US008613588B2

(12) United States Patent
Chen

(10) Patent No.: US 8,613,588 B2
(45) Date of Patent: Dec. 24, 2013

(54) FAN MODULE AND VIBRATION-DAMPING MOUNTING THEREFOR

(75) Inventor: Chih-Hua Chen, Taipei Hsien (TW)

(73) Assignee: Hon Hai Precision Industry Co., Ltd., New Taipei (TW)

( * ) Notice: Subject to any disclaimer, the term of this patent is extended or adjusted under 35 U.S.C. 154(b) by 456 days.

(21) Appl. No.: 12/982,883

(22) Filed: Dec. 31, 2010

(65) Prior Publication Data

US 2012/0114461 A1 May 10, 2012

(51) Int. Cl.
*F01D 25/04* (2006.01)

(52) U.S. Cl.
USPC ..... 415/119

(58) Field of Classification Search
USPC ..... 361/679.02
See application file for complete search history.

(56) References Cited

U.S. PATENT DOCUMENTS

| | | | | |
|---|---|---|---|---|
| 5,969,941 | A * | 10/1999 | Cho | 361/679.48 |
| 6,648,590 | B2 * | 11/2003 | Huang et al. | 415/53.1 |
| 7,374,397 | B2 * | 5/2008 | Lee et al. | 415/189 |
| 7,896,610 | B2 * | 3/2011 | Kao | 415/119 |
| 2009/0257187 | A1 * | 10/2009 | Mills et al. | 361/679.33 |

* cited by examiner

*Primary Examiner* — Nathaniel Wiehe
*Assistant Examiner* — Jeffrey A Brownson
(74) *Attorney, Agent, or Firm* — Altis Law Group, Inc.

(57) ABSTRACT

A fan module with vibration-damping mounting includes a cooling fan, a support frame and a clip detachably fixing the cooling fan to the support frame. The clip includes a mounting portion fixed to the support frame, fixing portions supporting the cooling fan, and vibration reducing portions. Each of the vibration reducing portions is connected between a corresponding fixing portion and the mounting portion. The fixing portions are spaced from the support frame, to prevent a vibration of the cooling fan from being transferred to the support frame.

19 Claims, 5 Drawing Sheets

FAN MODULE AND VIBRATION-DAMPING MOUNTING THEREFOR

BACKGROUND

1. Technical Field

The disclosure generally relates to device cooling, and particularly to a fan module and a vibration-damping mounting for the fan module.

2. Description of Related Art

A cooling fan is often mounted in a computer enclosure by screws. During operation, the cooling fan may generate unwanted vibration, with the result that noise due to vibration of the computer enclosure is generated. Worse yet, such vibration can adversely affect other components in the enclosure, such as hard discs, chips and others.

What is needed, therefore, is a fan module which can overcome the described limitations.

DETAILED DESCRIPTION

Figure 1:
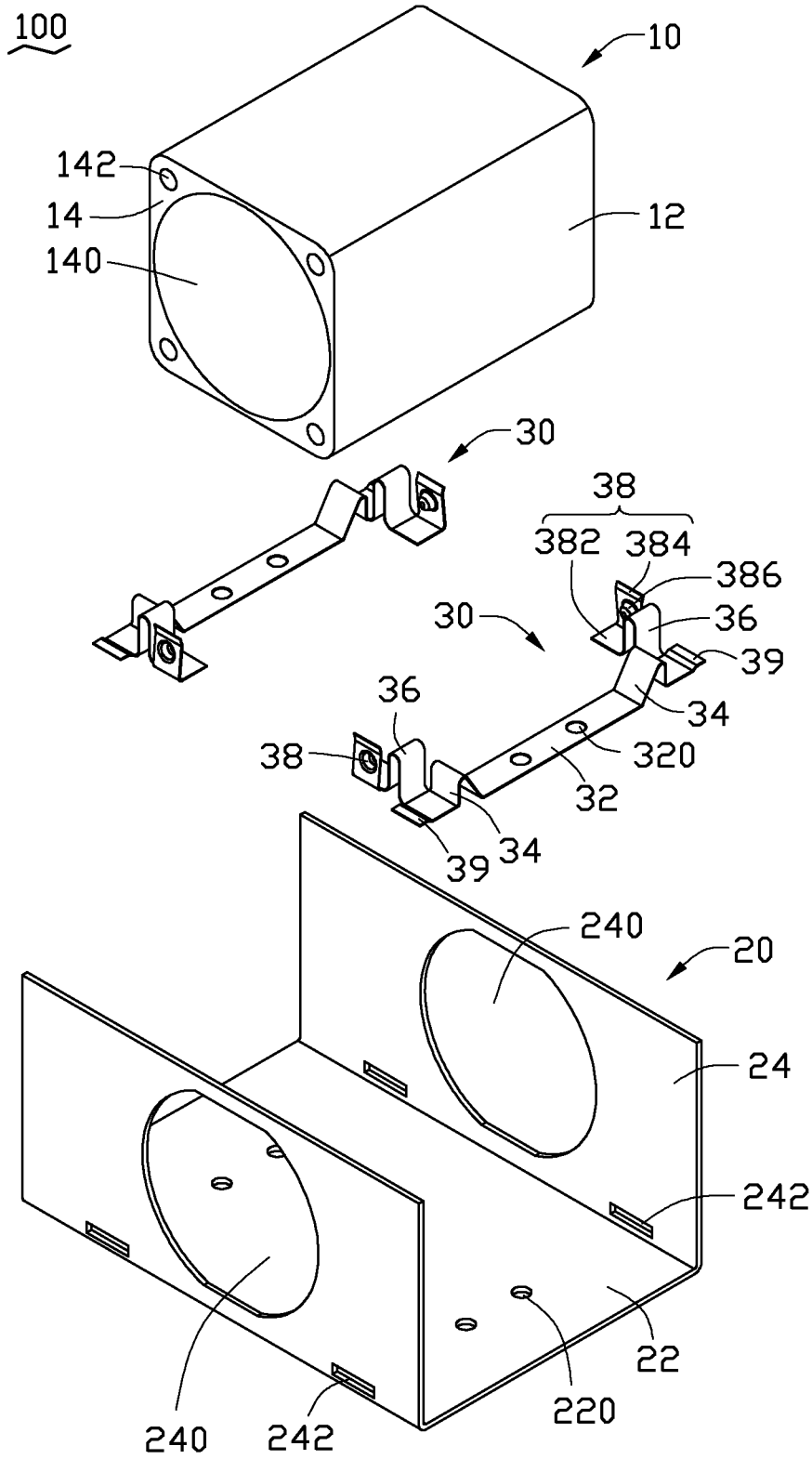
FIG. 1 is an exploded, isometric view of a fan module in accordance with a first embodiment of the disclosure.

FIG. 1 shows a fan module 100 according to a first embodiment of the disclosure. The fan module 100 includes a cooling fan 10, a support frame 20, and two clips 30 fixing the cooling fan 10 to the support frame 20.

The cooling fan 10 includes a housing 12, and a rotor (not shown) received in the housing 12. The housing 12 is cuboid and hollow, and defines a cylindrical receiving hole 140 for receiving the rotor. The receiving hole 140 extends through two opposite side surfaces 14 of the housing 12, thus defining an air inlet and an air outlet respectively at the side surfaces 14. Each side surface 14 defines four mounting holes 142 at four corners, respectively.

The support frame 20 is substantially U-shaped, and integrally formed as a single monolithic body of metal from a single metal plate. The support frame 20 includes a rectangular bottom plate 22, and two sidewalls 24 extending upwardly from two opposite lateral sides of the bottom plate 22, respectively. The sidewalls 24 are parallel to each other. A distance between the sidewalls 24 exceeds a distance between the two side surfaces 14 of the cooling fan 10 (i.e., a length of the cooling fan 10). Each of the sidewalls 24 defines an opening 240 substantially at the center thereof. The openings 240 of the sidewalls 24 are aligned. A diameter of each of the openings 240 is substantially equal to that of each of the air inlet and air outlet of the cooling fan 10. Each sidewall 24 defines two receiving grooves 242 adjacent to a bottom side thereof. The two receiving grooves 242 are at two opposite sides of the opening 240. The receiving grooves 242 of one sidewall 24 are respectively aligned with the receiving grooves 242 of the other sidewall 24.

The bottom plate 22 defines two pairs of securing holes 220 therein. One pair of securing holes 220 is arranged along an imaginary line connected between two aligned receiving grooves 242 of the two sidewalls 24. The other pair of securing holes 220 is arranged along an imaginary line connected between the other two aligned receiving grooves 242 of the two sidewalls 24.

The clips 30 are made of metal with high elasticity. The clips 30 are the same as each other, and are arranged in mirror symmetry. Each clip 30 includes a longitudinal mounting portion 32, two first vibration reducing portions 34 respectively extending from two distal ends of the mounting portion 32, two second vibration reducing portions 36 respectively extending from the first vibration reducing portions 34, and two fixing portion 38 respectively extending from the second vibration reducing portions 36.

The mounting portion 32 defines two fixing holes 320 along a length thereof. Each first vibration reducing portion 34 extends outwardly from a corresponding distal end of the mounting portion 32 along a longitudinal axis of the mounting portion 32. The first vibration reducing portion 34 includes a curved section extending from the distal end of the mounting portion 32, and a distal end extending from the curved section. The curved section is substantially V-shaped and protrudes upwardly. More specifically, the curved section of the first vibration reducing portion 34 initially extends upwardly from the distal end of the mounting portion 32 to a first position, and then downwardly to a second position above the mounting portion 32. The distal end of the first vibration reducing portion 34 extends horizontally from the second position. The distal end of the first vibration reducing portion 34 is parallel to and above the mounting portion 32.

The second vibration reducing portion 36 extends from one lateral side of the distal end of the corresponding first vibration reducing portion 34. The second vibration reducing portion 36 is curved and substantially U-shaped. The second vibration reducing portion 36 protrudes upwardly. More specifically, the second vibration reducing portion 36 initially extends upwardly from the distal end of the first vibration reducing portion 36 to a third position, and then downwardly from the third position to a fourth position. The fourth position is above the mounting portion 32. In this embodiment, the third position is above the first position. The fourth position and the section position are at the same level. That is, lowest points of the first vibration reducing portion 34 and the second vibration reducing portion 36 are at the same level. A tab 39 extends outwardly from an outer side of the distal end of the first vibration reducing portion 34, opposite to the mounting portion 32. The tab 39 initially extends upwardly from the distal end of the first vibration reducing portion 34, and then extends horizontally and outwardly along the longitudinal axis of the mounting portion 32. Thus overall the tab 39 extends outwardly, and is received in a corresponding receiving groove 242 of the sidewalls 24.

The fixing portion 38 includes a horizontal section 382 extending horizontally from a distal end of a corresponding second vibration reducing portion 36, and a vertical section 384 extending upwardly from an outer lateral side of the horizontal section 382. In this embodiment, each of the horizontal section 382 and the vertical section 384 is rectangular. The vertical sections 384 of the two fixing portions 38 face each other. Each vertical section 384 forms a latching post 386 protruding inwardly toward the latching post 386 of the other vertical section 384.

The clip 30 is slightly longer than the distance between the sidewalls 24 of the support frame 20. A distance between the two vertical sections 384 of the fixing portions 38 of the clip 30 is substantially equal to the length of the cooling fan 10. The second vibration reducing portions 36, the tabs 39 and the fixing portions 38 of the clip 30 are above the mounting portion 32.

Figure 2:
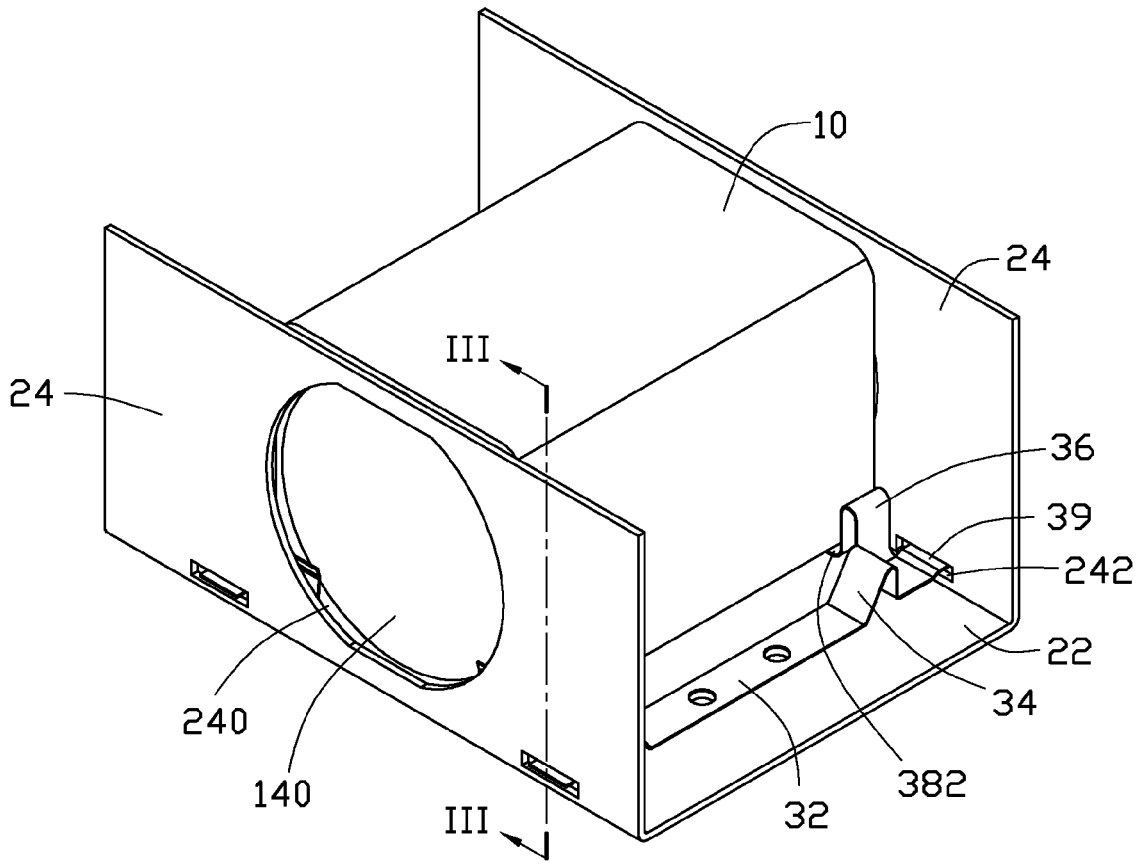
FIG. 2 is an assembled view of the fan module of FIG. 1.
Figure 3:
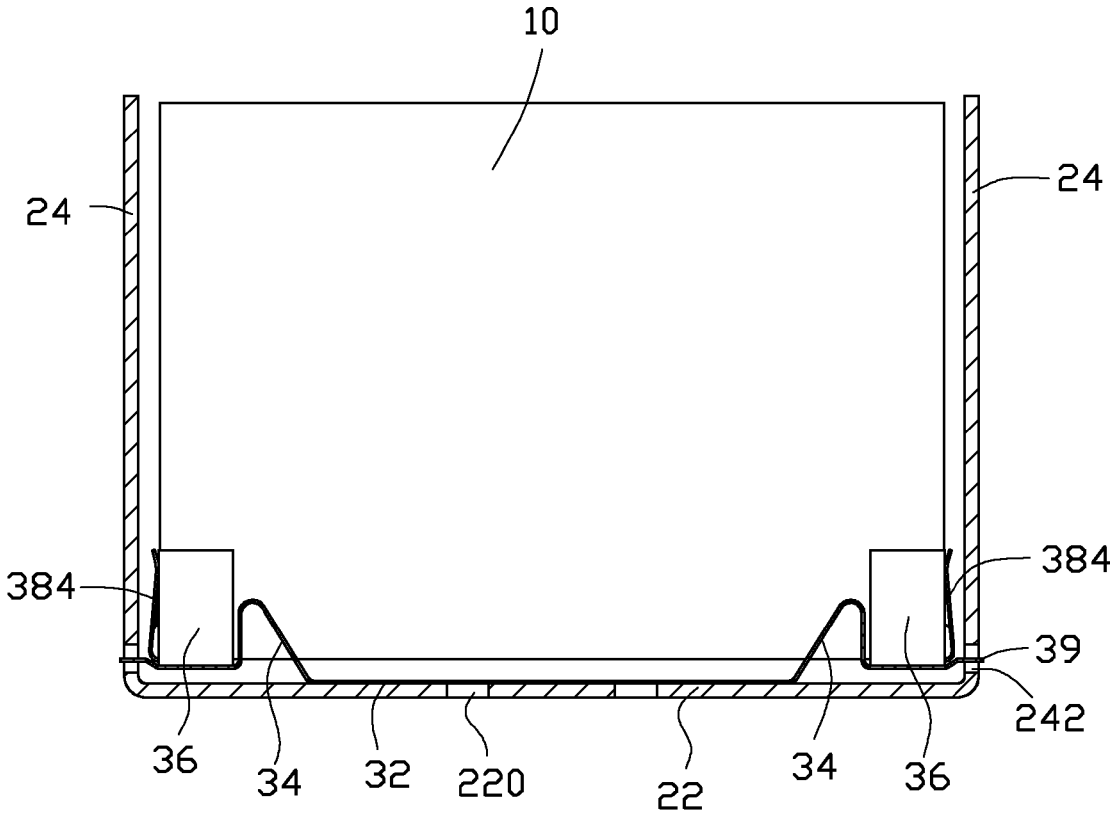
FIG. 3 is a cross section of the fan module of FIG. 2, taken along a line thereof.

Referring to FIGS. 2 and 3, in assembly of the fan module 100, the clips 30 are positioned between the sidewalls 24 of the support frame 20, with the second vibration reducing portions 36 of the two clips 30 facing each other and the fixing portions 38 of the two clips 30 facing each other. The tabs 39 of each clip 30 are received in two aligned receiving grooves 242 of the sidewalls 24. The mounting portions 32 of the clip 30 are attached to the bottom plate 22 of the support frame 20, with the fixing holes 320 of each mounting portion 32 are aligned with one pair of securing holes 220 of the bottom plate 22. Then, the clip 30 can be fixed to the support frame 20 by suitable fasteners such as screws. The first vibration reducing portions 34, the second vibration reducing portions 36 and the fixing portions 38 of the clip 30 are above and spaced from the bottom plate 22 of the support frame 20, and the fixing portions 38 of the clip 30 are spaced from the corresponding sidewalls 24 of the support frame 20.

The cooling fan 10 is placed between the sidewalls 24 of the support frame 20, with the receiving hole 140 aligned with the openings 240 of the sidewalls 24. Four corners of a bottom side of the cooling fan 10 are respectively supported by the horizontal sections 382 of the clips 30. The vertical sections 384 of the clips 30 are attached to bottom corners of the side surfaces 14 of the cooling fan 10, with the latching posts 386 respectively received in the mounting holes 142 of the side surfaces 14 of the cooling fan 10, whereby the cooling fan 10 is fixed to the fixing portions 38 of the clips 30. Accordingly, the first vibration reducing portions 34, the second vibration reducing portions 36 and the fixing portions 38 of the clips 30 are spaced from the support frame 20. The tabs 39 of the clips 30 are spaced from a periphery of the receiving groove 242.

Because the cooling fan 10 is fixed to the fixing portions 38 of the clips 30, and the fixing portions 38 are spaced from the support frame 20, any vibration of the cooling fan 10 during operation is not directly transferred to the support frame 20. In addition, in each clip 30, the first vibration reducing portions 34 and the second vibration reducing portions 36 are connected between the mounting portion 32 and the fixing portions 38, respectively. Thus when the cooling fan 10 vibrates, the first and second vibration reducing portions 34, 36 deform and absorb the vibration. Accordingly, vibration of the support frame 20 is avoided.

In disassembly of the cooling fan 10, the cooling fan 10 is to be pulled up, and initially the fixing portions 38 of the clips 30 move upward with the cooling fan 10. The tabs 39 abut top peripheral edges of the receiving grooves 242, limiting further upward movement of the fixing portions 38. Thus the latching posts 386 disengage from the mounting holes 142, and the cooling fan 10 is pulled free of the fixing portions 38 of the clips 30. In the above-described disassembly, because the tabs 39 abut the top peripheral edges of the receiving grooves 242, the tabs 39 effectively prevent the mounting portions 32 of the clips 30 from undergoing unwanted deformation.

Figure 4:
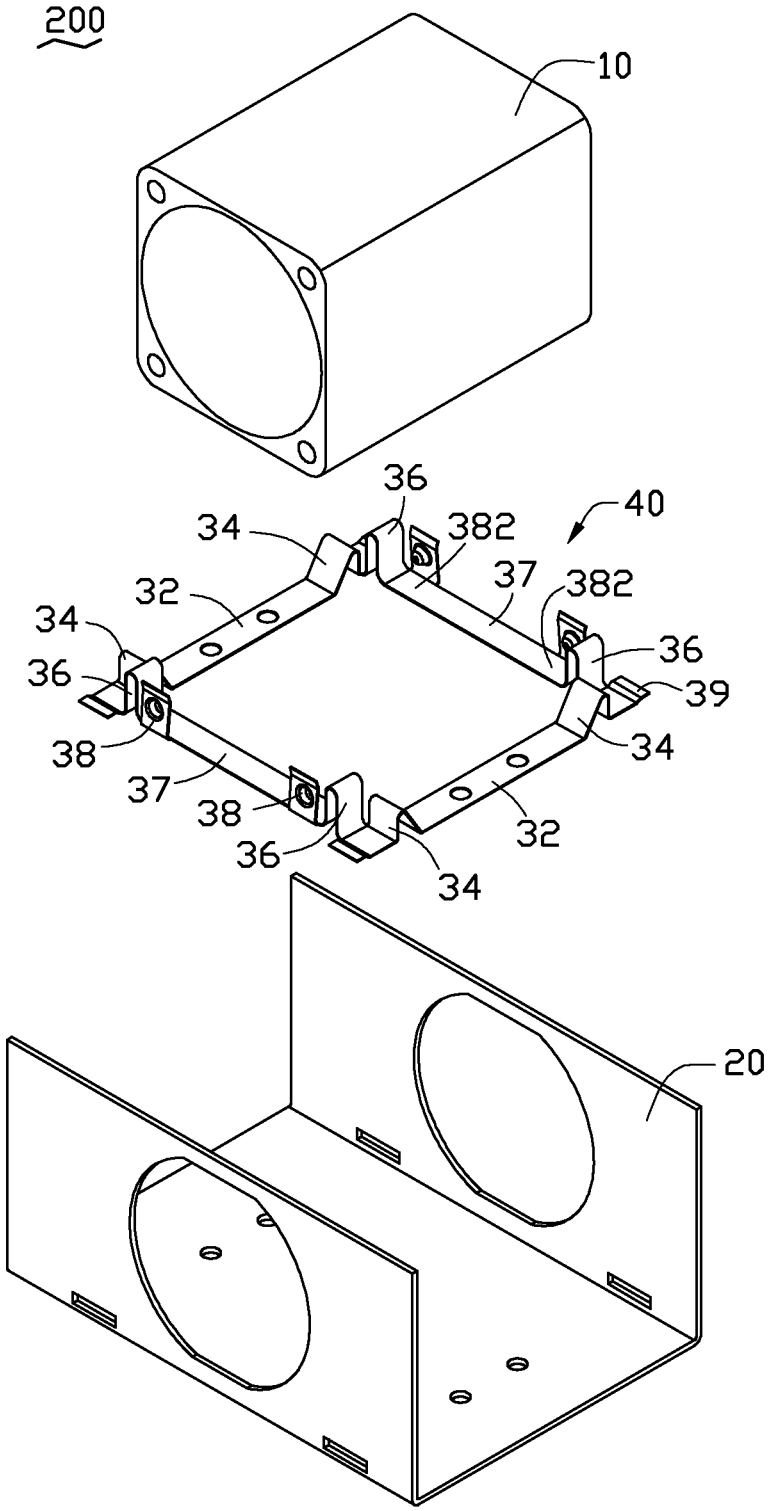
FIG. 4 is an exploded, isometric view of a fan module in accordance with a second embodiment of the disclosure.

FIG. 4 shows a fan module 200 according to a second embodiment of the disclosure. The fan module 200 differs from the fan module 100 of the first embodiment in that the fan module 200 includes only a single clip 40, which is different from the clips 30 of the first embodiment. In particular, the clip 40 can be considered to be formed by interconnecting the two clips 30 of the first embodiment. That is, two corresponding horizontal sections 382 of the two clips 30 are integrally interconnected by a connecting portion 37, and the other two corresponding horizontal sections 382 of the two clips 30 are integrally interconnected by another connecting portion 37. Accordingly, a mechanical strength of the clip 40 is increased. In addition, the clip 40 is substantially rectangular, with the fixing portions 38 at four corners thereof, respectively. After the cooling fan 10 has been assembled to the clip 40, the cooling fan 10 is not only supported by the horizontal sections 382 of the fixing portions 38, but also supported by the connecting portions 37. That is, the support provided to the cooling fan 10 is enhanced.

Figure 5:
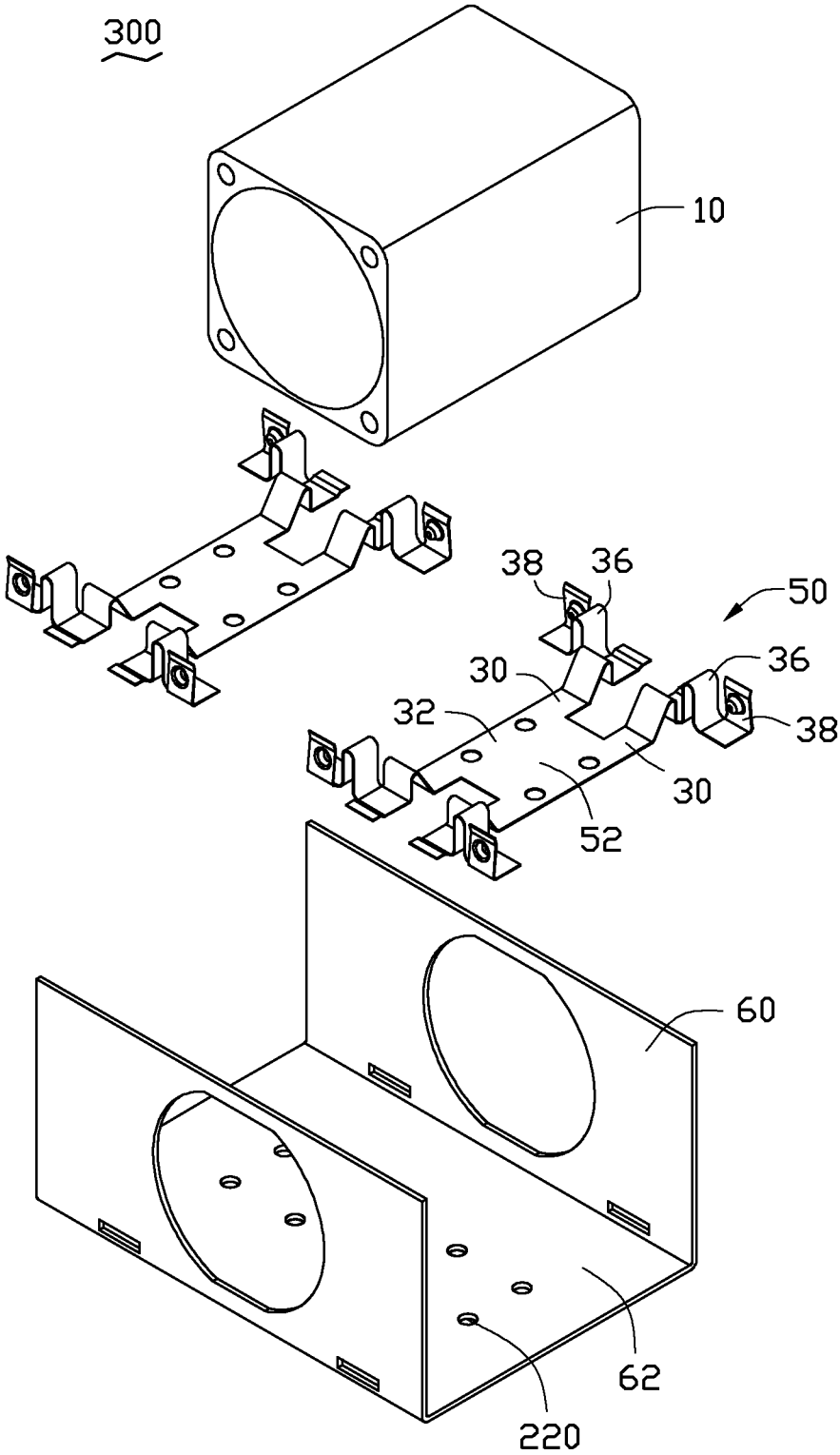
FIG. 5 is an exploded, isometric view of a fan module in accordance with a third embodiment of the disclosure.

FIG. 5 shows a fan module 300 according to a third embodiment of the disclosure. The fan module 300 differs from the first embodiment in the inclusion of two clips 50 different from the clips 30 of the first embodiment, and a support frame 60 different from the support frame 20 of the first embodiment.

In particular, each of the clips 50 can be considered to be formed by interconnecting the two clips 30 of the first embodiment. That is, each clip 50 is formed by integrally interconnecting the mounting portions 32 of the two clips 30 together with a connecting portion (not labeled). In each clip 50, the clips 30 are arranged in mirror symmetry, with two corresponding second vibration reducing portions 36 of the two clips 30 extending along opposite directions, and the other two corresponding second vibration reducing portions 36 of the two clips 30 extending along opposite directions. Thus, the four fixing portions 38 are respectively at four corners of the clip 50. Correspondingly, a bottom plate 62 of the frame 60 defines four pairs of fixing holes 220, with two pairs of fixing holes 220 matching one of the clips 50, and the other two pairs of fixing holes 220 matching the other clip 50.

In assembly of the fan module 300, only two of the fixing portions 38 of each clip 50 are used to fix the cooling fan 10. That is, the two fixing portions 38 at an inner side of each clip 50 are used to fix the cooling fan 10. The other two fixing portions 38 at an outer side of each clip 50 are reserved, for fixing of another adjacent cooling fan (not shown) beside the cooling fan 10.

It is to be understood, however, that even though numerous characteristics and advantages of certain embodiments have been set forth in the foregoing description, together with details of the structures and functions of the embodiments, the disclosure is illustrative only, and changes may be made in detail, especially in matters of shape, size, and arrangement of parts within the principles of the disclosure to the full extent indicated by the broad general meaning of the terms in which the appended claims are expressed.

What is claimed is:

1. A fan module with vibration-damping mounting, comprising:

a cooling fan;

a support frame; and at least one clip detachably fixing the cooling fan to the support frame, the at least one clip comprising a mounting portion fixed to the support frame, a plurality of fixing portions supporting the cooling fan, and a plurality of first vibration reducing portions, each of the first vibration reducing portions connected between a corresponding fixing portion and the mounting portion, and the fixing portion spaced from the support frame; and wherein the at least one clip comprises a plurality of tabs each extending outwardly from a corresponding first vibration reducing portion, the support frame defining a plurality of receiving grooves, the tabs of the clips being respectively received in the receiving grooves of the support frame and being suspended, each of the tabs being spaced from a periphery of the corresponding receiving groove without contacting any part of the support frame.

2. The fan module of claim 1, wherein the at least one clip comprises two clips, each of the two clips comprises the mounting portion and two fixing portions, the mounting portion is at a middle of the clip, the fixing portions are respectively at two ends of the mounting portion, and the fixing portions of the clips respectively support four corners of the cooling fan.

3. The fan module of claim 2, wherein each first vibration reducing portion is curved, protruding upwardly from the mounting portion, the first vibration reducing portion and the tabs being above the mounting portion.

4. The fan module of claim 3, wherein each first vibration reducing portion is substantially V-shaped.

5. The fan module of claim 3, wherein each clip further comprises two second vibration reducing portions, and each of the second vibration reducing portions is connected between a corresponding one of the first vibration reducing portions and a corresponding one of the fixing portions.

6. The fan module of claim 5, wherein each of the second vibration reducing portions is curved, protruding upwardly from the corresponding first vibration reducing portion.

7. The fan module of claim 6, wherein each of the second vibration reducing portions is substantially U-shaped.

8. The fan module of claim 2, wherein each of the fixing portions comprises a horizontal section supporting the cooling fan, and a vertical section extending upwardly from the horizontal section, the vertical section forms a latching post, and the cooling fan defines four mounting holes respectively engagingly receiving the latching posts of the fixing portions.

9. The fan module of claim 2, wherein two corresponding fixing portions of the two clips are interconnected by a connecting portion, and another two corresponding fixing portions of the two clips are interconnected by another connecting portion.

10. The fan module of claim 1, wherein the at least one clip comprises two clips, each of the two clips comprising the mounting portion and four fixing portions, the mounting portion is at a middle of the clip, the fixing portions are respectively at two ends of the mounting portion, two inner ones of the fixing portions of one of the clips respectively support two corners of the cooling fan, and two inner ones of the fixing portions of the other clip respectively support another two corners of the cooling fan.

11. The fan module of claim 1, wherein the support frame comprises a bottom plate and two sidewalls extending from two opposite sides of the bottom plate, the mounting portion of the at least one clip is fixed to the bottom plate, the fixing portions of the at least one clip are above the bottom plate, and the fixing portions of the at least one clip are spaced from the bottom plate and the sidewalls.

12. The fan module of claim 11, wherein the first vibration reducing portion extends upwardly from the mounting portion, and a distal end of the first vibration reducing portion is spaced from the bottom plate and the sidewalls of the support frame.

13. The fan module of claim 11, wherein the at least one clip further comprises two second vibration reducing portions, and each of the second vibration reducing portions is connected between a corresponding one of the first vibration reducing portions and a corresponding one of the fixing portions.

14. The fan module of claim 13, wherein the second vibration reducing portions are above and spaced from the bottom plate of the support frame, and are spaced from the sidewalls of the support frame.

15. A vibration-damping mounting for a fan, the vibration-damping mounting comprising:

a support frame; and a clip connected to the support frame, the clip comprising a mounting portion fixed to the support frame, a plurality of fixing portions configured for supporting the fan thereon, and a plurality of first vibration reducing portions, each of the first vibration reducing portions connected between a corresponding fixing portion and the mounting portion, the fixing portion being spaced from the support frame; and wherein the at least one clip comprises a plurality of tabs each extending outwardly from a corresponding first vibration reducing portion, the support frame defining a plurality of receiving grooves, the tabs of the clips being respectively received in the receiving grooves of the support frame and being suspended, each of the tabs being spaced from a periphery of the corresponding receiving groove without contacting any part of the support frame.

16. The vibration-damping mounting of claim 15, wherein each of the first vibration reducing portions is curved, protruding upwardly from the mounting portion, the first vibration reducing portions and the tabs being above the mounting portion.

17. The vibration-damping mounting of claim 16, wherein each first vibration reducing portion is substantially V-shaped.

18. The vibration-damping mounting of claim 15, wherein the clip further comprises a plurality of second vibration reducing portions, and each of the second vibration reducing portions is connected between a corresponding one of the first vibration reducing portions and a corresponding one of the fixing portions.

19. The vibration-damping mounting of claim 18, wherein each of the second vibration reducing portions is substantially U-shaped.

* * * * *